US005588552A

United States Patent [19]

Johnson

[11] Patent Number: 5,588,552

[45] Date of Patent: Dec. 31, 1996

[54] DISPOSABLE ROLLED RIM CUP AND LID CLOSURE

[76] Inventor: Timothy C. Johnson, 287-3 Dorchester St., Boston, Mass. 02127

[21] Appl. No.: 463,056

[22] Filed: Jun. 5, 1995

[51] Int. Cl.[6] ..... A47G 19/22

[52] U.S. Cl. ..... 220/712; 220/315; 220/212.5; 229/404; 229/4.5

[58] Field of Search ..... 220/315, 318, 220/324, 254, 270, 212.5, 671, 675, 680, 678, 677, 711, 712, 713, 307; 215/379, 382, 387; 229/400, 404, 4.5, 5.5

[56] References Cited

U.S. PATENT DOCUMENTS

| | | | |
|---|---|---|---|
| 1,766,226 | 6/1930 | Nias et al. . | |
| 1,992,144 | 2/1935 | Conti . | |
| 2,016,434 | 10/1935 | Huntley . | |
| 2,304,278 | 12/1942 | Poster . | |
| 3,133,665 | 5/1964 | Colhouer | 220/318 |
| 3,278,074 | 10/1966 | Yamazaki | 220/4.21 |
| 3,327,895 | 6/1967 | Mueller . | |
| 3,568,878 | 3/1971 | Fotos . | |
| 3,722,784 | 3/1973 | Harper . | |
| 4,127,187 | 11/1978 | Smith | 229/404 X |
| 4,412,644 | 11/1983 | La Fever | 220/713 X |
| 4,460,103 | 7/1984 | Rama et al. . | |
| 4,630,733 | 12/1986 | Fear . | |
| 4,762,426 | 8/1988 | Ashley et al. | 220/270 |
| 5,007,578 | 4/1991 | Simone | 229/400 |
| 5,203,481 | 4/1993 | Dobbins et al. | 215/399 X |

FOREIGN PATENT DOCUMENTS

| | | | |
|---|---|---|---|
| 9743 | of 1929 | Australia | 229/404 |
| 833719 | 10/1938 | France | 220/713 |

*Primary Examiner*—Stephen K. Cronin
*Attorney, Agent, or Firm*—George W. Neuner

[57] ABSTRACT

A container and closure are described. The container has a circular sidewall with a bottom and an open end defining a volume for containing a liquid, the sidewall having (i) a reinforced rim at the open end, (ii) a lid seat integrally formed in the sidewall and offset from the open end, (iii) a comfort zone extending along the sidewall from the bottom to the open end and (iv) a rim tab located on the inside of the container sidewall at the comfort zone adjacent the open end. The rim tab extends beyond the open end of the container. The closure is a circular substrate having (a) a diameter to seat in the lid seat of the container, (b) a plurality of peripheral tabs extending beyond the diameter of the substrate and (c) a pull tab located near an outer edge of the substrate which when pulled provides an opening through which liquid can pass when the closure is seated in the lid seat of the container. The peripheral tabs are preferably (1) a first tab having a slotted opening to accept the rim tab and (2) two or more talon tabs, each having an opening adapted and located to engage the rim of the container.

9 Claims, 6 Drawing Sheets

DISPOSABLE ROLLED RIM CUP AND LID CLOSURE

FIELD OF THE INVENTION

This invention is related to the field of disposable drink containers, particularly, drink containers having non-spill covers and, more particularly, drink containers and closures made from biodegradable materials.

BACKGROUND OF THE INVENTION

Disposable drink containers having non-spill covers are desirable for many applications such as carrying hot coffee, tea, chocolate, or soup, or cold drinks such as water, tea, soft drinks, etc.

Disposable containers made of laminated or waxed paper or of a thermoformed plastic have long been used. Descriptions of such containers can be found, for example, in U.S. Pat. No. 1,766,226; U.S. Pat. No. 1,992,144; U.S. Pat. No. 2,016,434; U.S. Pat. No. 2,304,278; U.S. Pat. No. 3,327,895 and U.S. Pat. No. 3,568,878. Closures for such containers have also been used. Descriptions of closures can be found, for example, in U.S. Pat. No. 3,722,784; U.S. Pat. No. 3,927,794; U.S. Pat. No. 4,081,103; U.S. Pat. No. 4,138,033; U.S. Pat. No. 4,184,604; U.S. Pat. No. 4,190,174; U.S. Pat. No. 4,141,462 and U.S. Pat. No. 4,460,103.

Early designs of paper closures for paper cups or containers were not readily replaceable after removing or did not provide resistance to spilling. Later designs of closures for disposable cups were generally thermoformed plastic closures. Such designs are not easily adapted to formation of closures from biodegradable materials such as paper and paper laminates.

Thus, it can be appreciated that improvements in disposable container and closure structures are desirable, particularly, improved structures that can be formed of biodegradable paper or paper-like materials and yet provide easily placeable non-spilling closures.

SUMMARY OF THE INVENTION

The present invention provides a novel container and closure, the structure of which is readily formed from biodegradable paper or paper-like materials. The container of the present invention comprises a generally, conically-shaped sidewall with a bottom and an open end defining a volume for containing fluids, the sidewall having (i) a comfort zone along an arc of the circumference of the sidewall, the comfort zone extending substantially from the bottom to the open end, (ii) a reinforced rim, (iii) a lid seat integrally formed in the sidewall and offset from the open end and (iv) a rim tab located on the sidewall at the comfort zone adjacent the open end, the rim tab extending beyond the open end of the container.

The closure or lid of the present invention comprises a circular substrate having a predetermined diameter, a plurality of peripheral tabs extending beyond the diameter, and a pull tab located near the outer edge of the substrate, which may be grasped and pulled to provide an opening through the substrate. Preferably, a first peripheral tab, or hinge tab, is located diametrically opposite the pull tab and has a slot substantially parallel to an edge of the substrate and located approximately in line with the circumference of the substrate. The other peripheral tabs are talon tabs located along the circumference of the substrate, preferably one in each space between the pull tab and the hinge tab. The talon tabs have a pre-cut pattern which is constructed and adapted so that, when the closure is inserted in the open end of a container having a rim, the talon bends along a radial line from the center of the substrate and forms an opening within the talon tab and a latch to enable the talon to automatically catch on the rim of the container.

When the closure and container of the invention are used in combination, the rim tab of the container is positioned to slip through the hinge tab and align the closure on the container so that the pull tab is directly opposite the sidewall comfort zone on the container. When so aligned, the sidewall comfort zone provides an area on the sidewall for comfortable placement of the fingers while the offset of the lid set from the open end provides a comfortable place for the thumb to enable drinking hot and cold drinks without feeling extreme temperatures by the hand holding the container. The closure is predetermined to have a diameter to fit snugly on the lid seat inside the container and the talons are adapted and sized so that the latch formed by the talons as the closure is inserted into the container engages the rim of the container when the closure is seated on the lid seat, thereby providing a no-spill cover for the container.

The closure of the invention can be made with a plurality of talons, e.g. two or three, and a pull tab for use on containers without a rim tab.

The container and closure of the present invention are particularly designed to be constructed of biodegradable paper or paper-like materials. When so constructed the closure is conveniently made of two or more layers of material as will be discussed in more detail below.

The container and closure provide a lower fill level, below the lid seat so that there is greater safety for containment of liquid when the user removes the closure to stir, to add ingredients such as cream or sugar to coffee, etc. The position of the closure provides a splash guard when drinking through the pull tab opening. Liquid must travel through the opening, up and over the offset from the rim in order to splash the user. The container and closure of the present invention provide a secure finger hold at the rim with a rim comfort zone to hold the container, particularly when the closure is seated in the lid seat. With minimal obstruction from the tabs, the user can comfortably hold the container at the sidewall and rim comfort zones and drink through the pull tab opening in the closure.

DETAILED DESCRIPTION OF THE INVENTION

Figure 1:
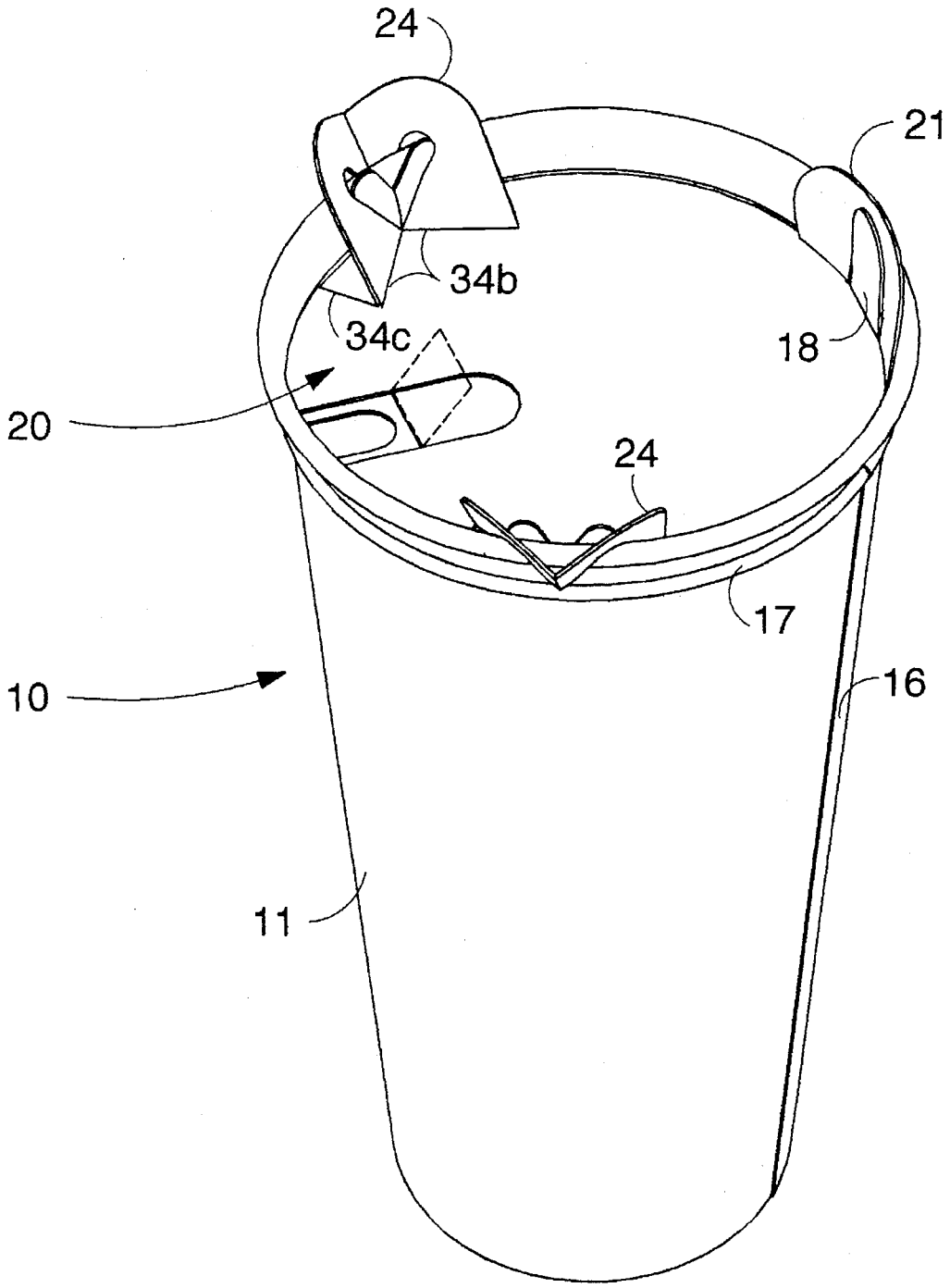
FIG. 1 is an isometric view of a preferred embodiment of a container and closure in accord with the present invention.
Figure 2B:
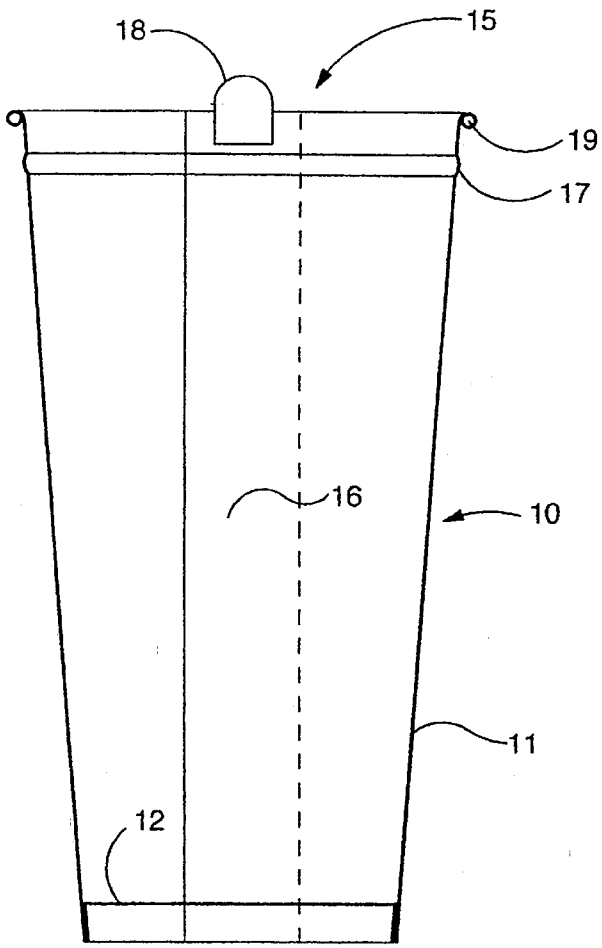
FIG. 2B is a cross-sectional side elevation view of the container illustrated in FIG. 1.
Figure 2A:
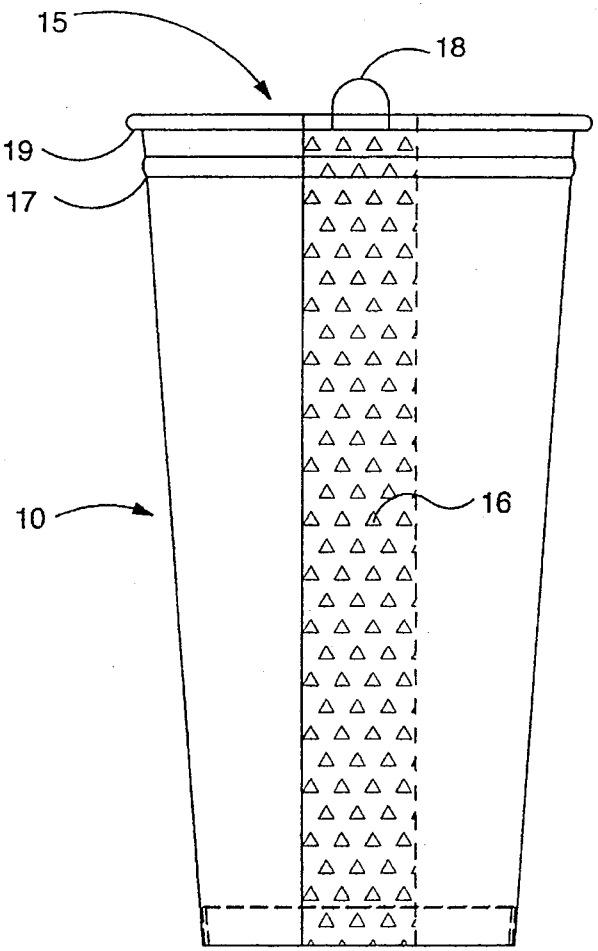
FIG. 2A is a side elevation view of the container illustrated in FIG. 1.

The invention will now be described in detail with reference to the drawings. A preferred embodiment of the invention is illustrated by container 10 and closure 20 (FIG. 1). The container 10 has a standard size and shape, being formed of a sidewall 11 and a bottom 12, and having an open end 15 (FIG. 2) Extending from the top to the bottom of the sidewall is a comfort zone 16, formed by overlapping the sidewall material in a wide seam when made from paper or paper-like material. In a preferred embodiment, the overlapped sidewall area or seam is textured, e.g., with a knurled outer surface. The sidewall comfort zone alternatively can be designed into a thermoformed container or provided by a piece of additional material, preferably an insulating material. The dimension of the sidewall comfort zone along the circumference of the container should be adequate for positioning finger tips when holding the container for drinking. Preferably, the sidewall comfort zone is at least a centimeter wide, more preferably, at least two centimeters wide.

The container has a lid seat 17, which is offset from the open end, to receive a closure or lid. The lid seat is integrally formed in the sidewall when making the container by stretching the paper or paper-like material to just below its stretch limit to form the lid seat. That typically leaves an arcuate depression in the side wall approximately at least about 0.2 mm deep, preferably about 0.5 mm deep. The arc length of the depression, or the length of the depression measured along the sidewall is commensurate with the thickness of the closure to be seated therein. In a preferred embodiment, the arc length is 4 mm. When thermoplastic is used, the lid seat is designed to have a depth within the stretch limit of the thermoplastic, so that the lid can snap into place without cracking the container.

The lid seat is offset from the open end a distance to permit drinking without discomfort and to provide a splash guard. An offset of about 1 cm has been found suitable, however, other dimensions can be used.

The container 10 also has a rim tab 18 located adjacent the open end and preferably, in the area of the sidewall comfort zone. The rim tab is preferably integral with the sidewall and is used to position the closure so that the pull tab opening of the closure is opposite the sidewall comfort zone. This positions the hand for comfortable drinking of hot and cold beverages with the non-spill lid in place. The rim tab thus is preferably located to extend over the rim 19 of the container for easy placement of the closure. In a preferred embodiment, the rim tab is integral with the sidewall about 1 cm wide and extends about 7 mm above the rim. However, any dimensions that accomplish the purpose of the rim tab can be used.

The rim 19 itself is typically a standard rolled rim when the container is made of paper or paper-like material. This reinforces the rim structure to maintain shape during use. Other known methods for rim reinforcement can also be used. For example, with plastic containers, extra material in the form of a bead can be used to strengthen and reinforce the rim.

Figures 3A, 3B:
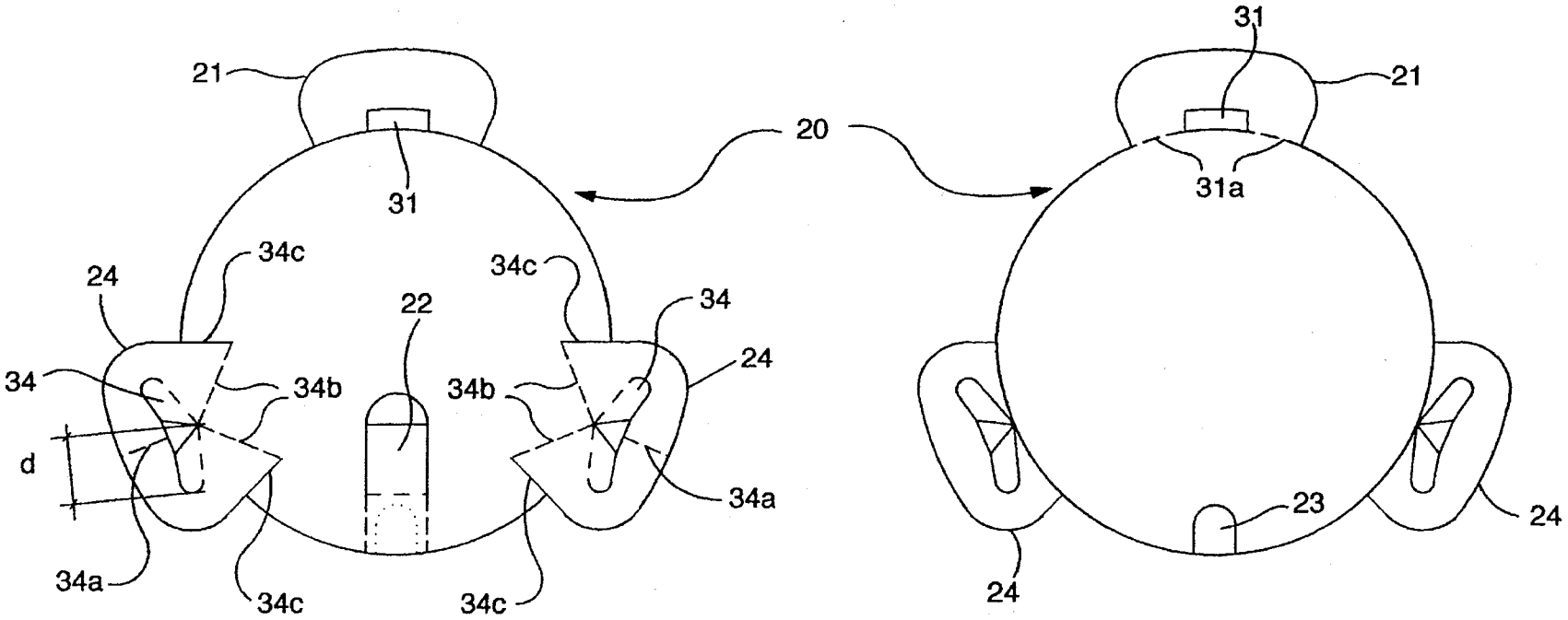
FIG. 3A is a plan view of the closure illustrated in FIG. 1.
FIG. 3B is a bottom view of the closure illustrated in FIG. 3A.

The closure 20, in accord with a preferred embodiment of the invention, is conveniently made of substrate having two layers of material to form a relatively stiff lid that can be seated in the lid seat of a container but have some flexibility for seating. The closure has a plurality of tabs. See FIGS. 3A, 3B. A peripheral hinge tab 21 is constructed and adapted for locating the closure on the container so that the pull tab 22 and opening 23 are opposite the sidewall comfort zone 16. The closure hinge tab 21 has a slot 31 to accommodate the container rim tab 18. The hinge tab bends at fold line 31*a* when the closure is seated in the container. Conveniently the hinge tab is about twice the width of the rim tab. Suitable dimensions are readily selected by the mechanical designer.

Figure 4B:
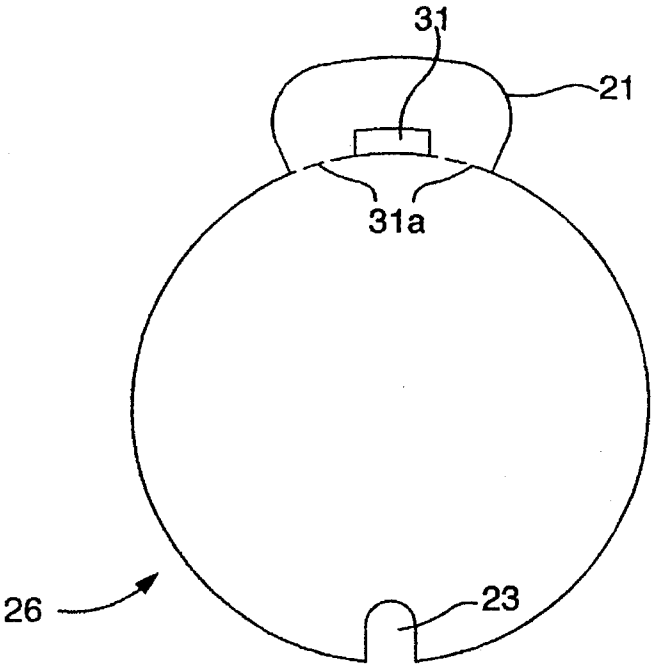
FIG. 4B illustrates a layout pattern for the bottom layer of a closure as illustrated in FIGS. 3A and 3B.

The pull tab 22 covers opening 23, through which the liquid in the container can be accessed when the closure is seated in the lid seat and the pull tab 22 is removed to expose the opening 23. Conveniently, an opening 25 is provided in the upper layer of the closure to facilitate lifting pull tab 22 to expose the underlying opening 23 (FIGS. 4A, 4B).

A preferred closure also has two or more peripheral talon tabs 24 for engaging the rim of the container when the closure is seated thereby preventing the lid or closure from being pushed past the lid seat into the container. Each talon tab has an opening 34 and is constructed and adapted so that when inserted into the container for seating, the talon bends along radial fold line 34*a* and fold lines 34*b*. To facilitate bending at fold lines 34*b*, the talons are pre-grooved at fold lines 34*b* and are pre-scored at 34*c* so that the sides of the talons can lift from the bottom portion of the closure to permit folding at the fold lines to deploy the talon to engage the rim of the container.

The closure lid 20 is conveniently made of two layers. When made of two layers of paper or paper-like material, the layers are preferably oriented so that the grain of one layer is at a right angle to the grain of the other layer for increased strength. In a preferred embodiment, the bottom layer 26 is an essentially circular disk having integral hinge tab 21 on its periphery and opening 23 through which the liquid can be accessed when the pull tab is removed. The diameter of the disk is sized to fit snugly when seated in the lid seat of the container.

Figure 4A:
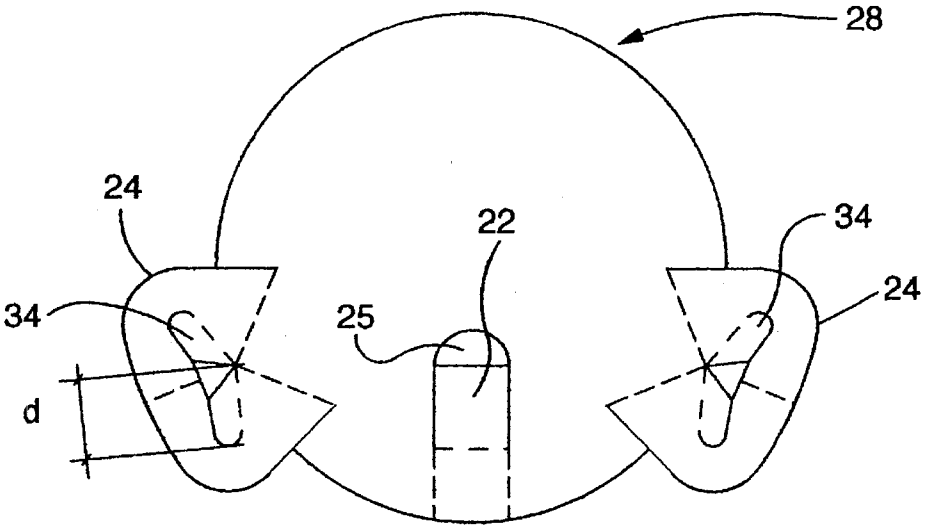
FIG. 4A illustrates a layout pattern for the top layer of a closure as illustrated in FIGS. 3A and 3B.

The top layer 28 also is a substantially circular disk having the same diameter as the bottom layer 26, having the pull tab 22 within the diameter, and having peripheral talon tabs 24 that extend beyond the circular diameter as shown in FIG. 4A. An opening 25 and prescored lines (as illustrated) are conveniently provided in layer 28 to facilitate pulling the tab 22. The distance "d" of each talon tab 24 is dimensioned so that the talon engages the rim 19 of the container 10 when the closure 20 is seated in the lid seat 17. The fold lines 34*b* are conveniently pre-grooved at right angles to each other and at 45 degrees to radial fold line 34*a*, as illustrated in FIG. 4A, with pre-scored lines 34*c* along radii in the surface of the closure. However, other pre-grooved fold line at angles designed with suitable pre-scored surface lines can be constructed and adapted by the skilled mechanic to perform the desired function of the talon. Prescored lines in the layer material around the area for opening 34, and within the area for the opening if desired (see FIG. 4A), in each talon tab 24 facilitate bending of the talon tab and engagement of the talon tab with the rim of the container.

Figure 5B:
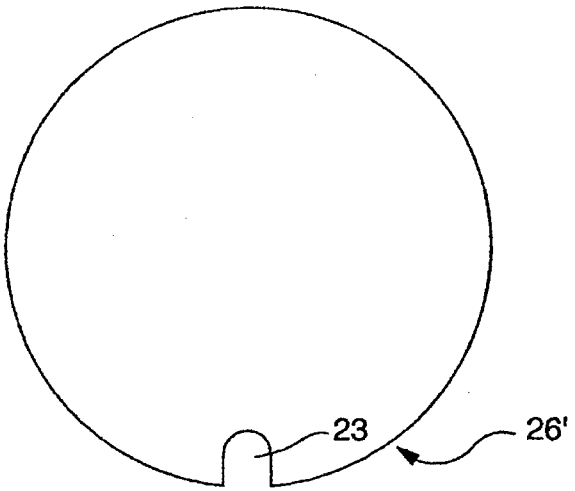
FIG. 5B illustrates an alternative layout pattern for the bottom layer of a closure.
Figure 5A:
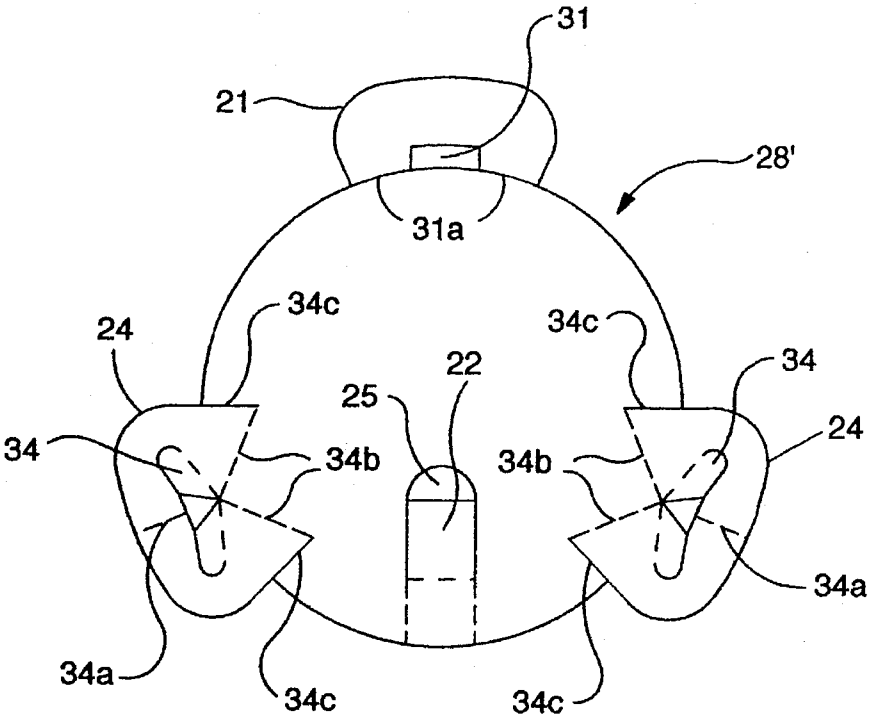
FIG. 5A illustrates an alternative layout pattern for the top layer of a closure.

Alternatively, in a two layer construction of the closure, the bottom layer 26' has only the opening 23 as illustrated in FIG. 5B. In such construction, the hinge tab 21 is integrally formed with the top layer 28' (FIG. 5A).

Conveniently, the container and closure are constructed of material formed of recycled fiber. An aqueous barrier coating is used to prevent leakage. Any conventional coatings for paper containers can be used.

Figure 6B:
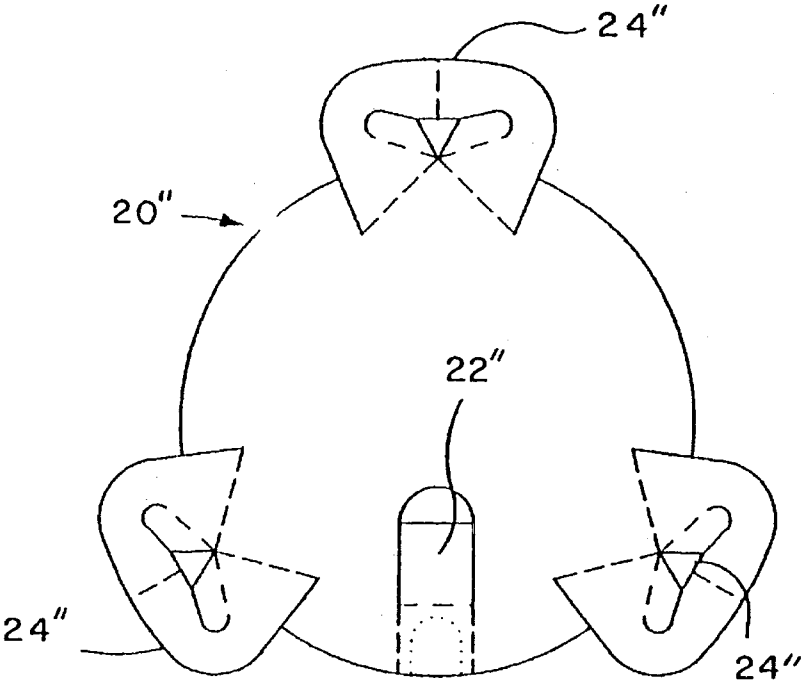
FIG. 6B is a plan view of the closure of the invention having three talon tabs.
Figure 6A:
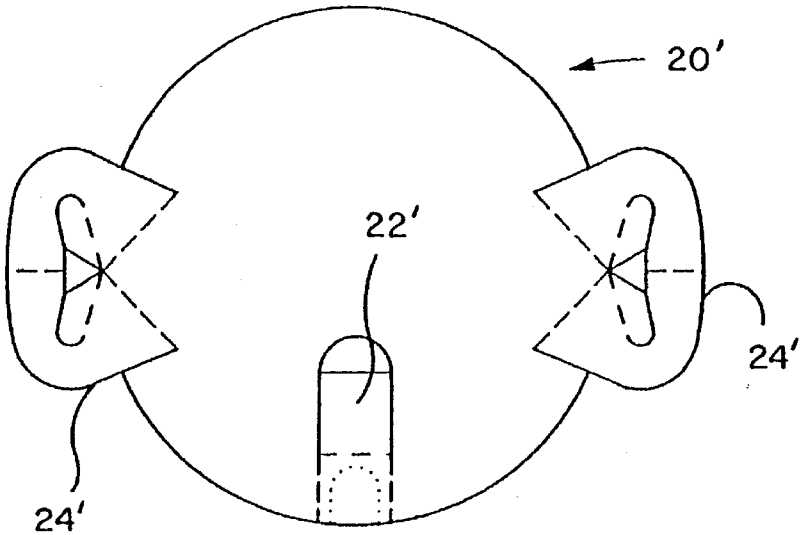
FIG. 6A is a plan view of the closure of the invention having two talon tabs.

The invention also provides a closure having two or more talon tabs for removably sealing a container. See FIGS. 6A, 6B. If two talon tabs 24' are used for placing the closure on the container for sealing, the two talons are placed along a diameter of the closure and are sized to provide stability for the closure (FIG. 6A). Preferably, the two talon tabs each extend along the circumference for at least an arc distance subtended by an angle of 30 degrees measured from the center of the closure, preferably at least 45 degrees. In a preferred embodiment, three talon tabs 24" are spaced 120 degrees and used to stabilize the closure 20" (FIG. 6B). The closure 20', 20" also can be provided with a pull tab 22', 22" so that access to the contents in the container can be provided without removal of the closure.

The invention has been described in detail with reference to the preferred embodiments thereof. However, it will be appreciated that those skilled in the art, upon consideration of the disclosure in this specification including the drawings, may make modifications and improvements within the spirit and scope of the present invention.

What is claimed is:

1. A container and closure, the container comprising a circular sidewall with a bottom and an open end defining a volume for containing a liquid, the sidewall having (i) a reinforced rim at the open end, (ii) a lid seat integrally formed in the sidewall and offset from the open end, (iii) a comfort zone extending along the sidewall from the bottom to the open end and (iv) a rim tab located on the inside of the container sidewall at the comfort zone adjacent the open end, the rim tab extending beyond the open end of the container;

the closure comprising a circular substrate having: (a) a diameter to seat in the lid seat of the container, (b) a plurality of peripheral tabs extending beyond the diameter of the substrate and (c) a pull tab located near an outer edge of the substrate which when pulled provides an opening through which liquid can pass when the closure is seated in the lid seat of the container;

wherein the peripheral tabs comprise: (1) a first tab having a slotted opening that is substantially aligned with the circumference of the substrate, the slotted opening capable of accepting the rim tab of the container for positioning the closure with respect to the container; and (2) two or more talon tabs, each having an opening adapted and located so that, when the closure is seated in the lid seat of the container, the talon firmly engages the rim of the container by means of the opening to prevent the closure from being pushed into the container.

2. The container and closure of claim 1 wherein the comfort zone is formed by an overlapping of material to form a seam in the sidewall.

3. The container and closure of claim 2 wherein the seam has a textured outer surface.

4. The container and closure of claim 1 wherein the closure is formed of two layers of material, the first layer comprising a circular disk having an opening within the circumference of the disk, the second layer having the peripheral tabs and the pull tab integrally formed with pre-scored cuts for the openings within the tabs, the two layers being joined together so that the pull tab of the second layer covers the opening in the first layer.

5. The container and closure of claim 4, wherein the pull tab is located along a diameter line opposite the first tab.

6. The container and closure of claim 1 wherein each talon tab is located along the circumference of the closure 120' from the first tab.

7. A closure and a container, the container having (i) a circular sidewall with a bottom and an open end with a rim defining a volume for containing a liquid, the closure comprising: a circular substrate having: (a) a diameter to fit within the circular sidewall of the container and to seal the container and (b) a plurality of peripheral talon tabs extending beyond the diameter of the substrate, each talon tab having an opening adapted and located so that, when the closure is placed to seal the container, the talon firmly engages the rim of the container by means of the opening to prevent the closure from being pushed into the container.

8. A closure for a container having (i) a circular sidewall with a bottom and an open end with a rim defining a volume for containing a liquid, the closure comprising: a circular substrate having: (a) a diameter to seal the container and (b) a plurality of peripheral talon tabs extending beyond the diameter of the substrate, each talon tab having an opening adapted and located so that, when the closure is placed to seal the container, the talon firmly engages the rim of the container by means of the opening to prevent the closure from being pushed into the container, the closure further comprising a pull tab located near an outer edge of the substrate which when pulled provides an opening through which liquid can pass when the closure is placed to seal the container.

9. A closure for a container having (i) a circular sidewall with a bottom and an open end with a rim defining a volume for containing a liquid, the closure comprising: a circular substrate having: (a) a diameter to seal the container and (b) a plurality of peripheral talon tabs extending beyond the diameter of the substrate, each talon tab having an opening adapted and located so that, when the closure is placed to seal the container, the talon firmly engages the rim of the container by means of the opening to prevent the closure from being pushed into the container, wherein the closure is formed of two layers of material, the first layer comprising a circular disk having an opening within the circumference of the disk, the second layer having the peripheral tabs and the pull tab integrally formed with pre-scored cuts for the openings within the tabs, the two layers being joined together so that the pull tab of the second layer covers the opening in the first layer.

* * * * *